US006722714B2

(12) United States Patent
Ooe et al.

(10) Patent No.: US 6,722,714 B2
(45) Date of Patent: Apr. 20, 2004

(54) VEHICULAR DOOR OPENING AND CLOSING APPARATUS

(75) Inventors: Kouji Ooe, Nagoya (JP); Nobuhiro Yamauchi, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/740,879

(22) Filed: Dec. 21, 2000

(65) Prior Publication Data

US 2001/0005959 A1 Jul. 5, 2001

(30) Foreign Application Priority Data

Dec. 22, 1999 (JP) ..... 11-365183

(51) Int. Cl.[7] ..... E05C 3/06; E05C 17/00; E06B 3/00

(52) U.S. Cl. ..... 292/216; 49/503; 49/394; 292/DIG. 23

(58) Field of Search ..... 49/503, 502, 394; 296/152, 146.1; 292/216, 201, DIG. 23

(56) References Cited

U.S. PATENT DOCUMENTS

| | | | | |
|---|---|---|---|---|
| 3,511,526 A | * | 5/1970 | Ploughman | 292/216 |
| 4,603,894 A | | 8/1986 | Osenkowski | |
| 5,234,237 A | | 8/1993 | Gergoe et al. | |
| 5,348,357 A | * | 9/1994 | Konchan et al. | 292/216 |
| 5,494,321 A | * | 2/1996 | Ishihara et al. | 292/DIG. 23 X |
| 5,876,074 A | * | 3/1999 | Dowling | 292/DIG. 23 X |
| 5,975,596 A | * | 11/1999 | Rogers, Jr. et al. | 292/DIG. 23 X |
| 6,045,168 A | * | 4/2000 | Johnson et al. | 292/DIG. 23 X |
| 6,050,620 A | * | 4/2000 | Rogers, Jr. et al. | 292/DIG. 23 X |
| 6,053,543 A | * | 4/2000 | Arabia, Jr. et al. | 292/201 |
| 6,168,216 B1 | * | 1/2001 | Nakajima et al. | 292/DIG. 23 X |
| 6,189,940 B1 | * | 2/2001 | Hayakawa et al. | 292/DIG. 23 X |
| 6,223,468 B1 | * | 5/2001 | Kobayashi | 49/280 |
| 6,267,420 B1 | * | 7/2001 | Miyagawa | 292/216 |
| 6,305,727 B1 | * | 10/2001 | Bland | 292/DIG. 23 X |
| 6,332,634 B1 | * | 12/2001 | Fukumoto et al. | 292/DIG. 23 X |

FOREIGN PATENT DOCUMENTS

| | | |
|---|---|---|
| EP | 0 309 239 A2 | 3/1989 |
| EP | 0 492 288 A1 | 7/1992 |
| JP | 10-24737 | 1/1998 |

* cited by examiner

*Primary Examiner*—Daniel P. Stodola
*Assistant Examiner*—Hugh B. Thompson
(74) *Attorney, Agent, or Firm*—Burns, Doane, Swecker & Mathis, LLP

(57) ABSTRACT

To provide module formation of a lever unit and an inside handle unit, a vehicular door opening and closing apparatus includes a base unit (9) fixed to a door inner panel of a vehicular door, a compartment inner side opening operating member (61) pivotably supported by the base unit (9) and an open lever (43) connected and engaged with a latch unit (3) holding the compartment inner side opening operating member (61) pivotably supported by the base unit (9) and the vehicular door in a closed state relative to a vehicle body and a lever unit (4) is supported at an inside handle unit (6).

9 Claims, 13 Drawing Sheets

VEHICULAR DOOR OPENING AND CLOSING APPARATUS

BACKGROUND OF THE INVENTION

The present invention relates to a vehicular door opening and closing apparatus of a slide door for vehicles or the like.

Conventionally, there is known a vehicular door opening and closing apparatus of this kind such as disclosed in Japanese Patent Laid-Open Publication No. 24737/1998. This is a vehicular door opening and closing apparatus in which latch unit, lever unit and inside handle unit are arranged to a vehicular door independently from each other and respective units are connected and engaged with each other by rods.

The lever unit of the vehicular door opening and closing apparatus is provided with an open lever connected and engaged with the latch unit and an operating member on a compartment inner side via rods and the open lever is pivoted by operating the compartment inner side operating member to thereby operate the latch unit.

The open lever of the vehicular door opening and closing apparatus is pivotably supported by a base bracket supporting the lever unit at a door panel of the vehicular door separately and independently from a base supporting the compartment inner side operating member.

However, according to the above-described conventional apparatus, the lever unit and the inside handle unit are arranged at the vehicular door independently from each other and accordingly, a rod connecting the both members must be arranged at inside of the vehicular door and therefore, not only the assembling operation of the vehicular door becomes troublesome but also in the case of a vehicular door in which window glass is lifted and lowered, there is a concern that the rod arranging operation per se becomes difficult.

Hence, it is a technical problem of the invention to provide module of a lever unit and an inside handle unit.

SUMMARY OF THE INVENTION

According to technical means employed in the invention for resolving the above-described technical problem, basically, a lever unit is supported by an inside handle unit.

According to further technical means of the present invention, there is provided a vehicular door opening and closing apparatus comprising a base unit fixed to a door inner panel of the vehicular door, an opening operating member on a compartment inner side pivotably supported by the base unit, and an open lever pivotably supported by the base unit and connected and engaged with a latch unit holding the compartment inner side opening operating member and the vehicular door in a closed state relative to the vehicle body.

According to the technical means, the compartment inner side opening operating member and the open lever are supported by the base unit and the inside handle unit and the lever unit are integrated. Therefore, arrangement of rods, wires, cables or the like for connecting and engaging the inside handle unit and the lever unit in the vehicular door can be dispensed with.

Further preferably, the base unit may comprise a base bracket fixed to the door inner panel of the vehicular door for pivotably supporting the open lever, and a handle base fixed to the base bracket for pivotably supporting the compartment inner side opening operating member.

Further preferably, there may further be provided a locking lever pivotably supported by the base unit or the base bracket for engaging and disengaging engagement between the latch unit and the open lever, and a compartment inner side locking operating member connected and engaged with the locking lever and movably supported by the base unit or the handle base.

Further preferably, there may further be provided a lift lever pivotably supported by the base unit or the base bracket and connected and engaged with the latch unit, and a slide bush slidably supported by the lift lever, connected to the locking lever and engageable and disengageable with and from the open lever.

Further preferably, there may further be provided a coaxial shaft for pivotably supporting the lift lever and the open lever, a long hole in a shape of a circular arc formed at the locking lever and centering on the coaxial shaft, and a connecting pin portion formed at the slide bush and inserted into the long hole in the shape of the circular arc.

Further preferably, there may further be provided a locking actuator supported by the base unit or the base bracket, connected to the locking lever and connected to the compartment inner side locking operating member.

DETAILED DESCRIPTION OF THE PREFERRED EMBODIMENTS

Figure 1:
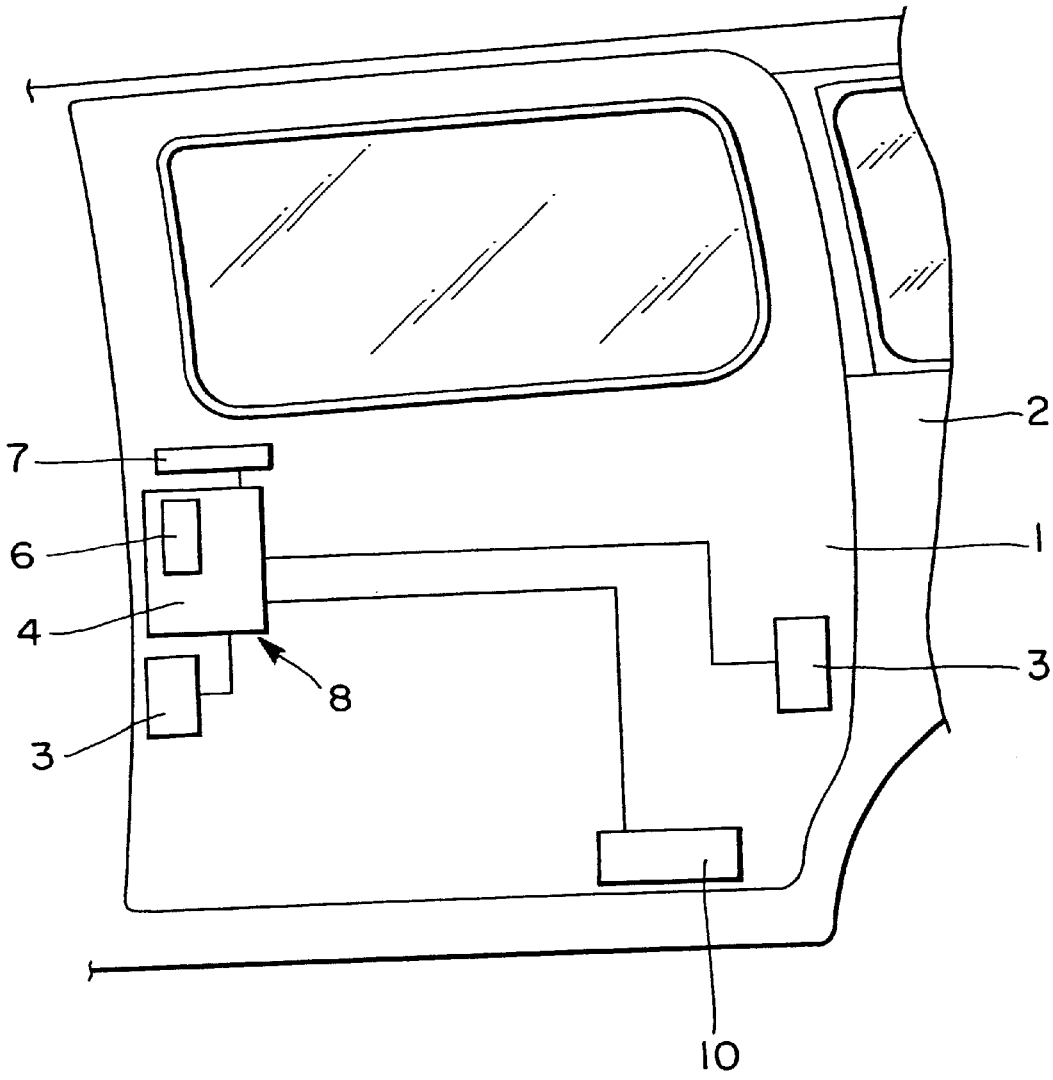
FIG. 1 is a front view showing a vehicular door mounted with a vehicular door opening and closing apparatus according to the invention.

As shown in FIG. 1, a slide door 1 of a vehicle is arranged with a pair of front and rear latch units 3 for holding the slide door 1 in a closed state relative to a vehicle body 2, a remote control unit 4 for operating the latch units 3, an inside handle unit 6 and an outside handle unit 7 for operating the remote control unit 4 and a fully open lock unit 10 for holding the slide door 1 in an opened state relative to the vehicle body.

Further, the latch unit 3 is of a well-known structure having a rotatable latch engaged with and disengaged from a striker of the vehicle body 2 and a rotatable pole restricting rotation of the latch by being engaged with the latch.

Further, the outside handle unit 7 is of a well-known structure having an outside handle pivotably supported by a handle base.

Further, the fully open lock unit 10 is of a well-known structure having a rotatable hook engaged with and disengaged from an engaging pin of the vehicle body. A detailed explanation of the well-known structures as mentioned above will be omitted.

The remote control unit 4 and the pair of front and rear latch units 3, the outside handle unit 7 and the remote control unit 4, and the fully open lock unit 10 and the remote control unit 4, are connected and engaged with each other by cables or rods arranged at the slide door 1 and the inside handle unit 6 and the remote control unit 4 are integrated to thereby constitute a door opening and closing apparatus 8.

Figure 2:
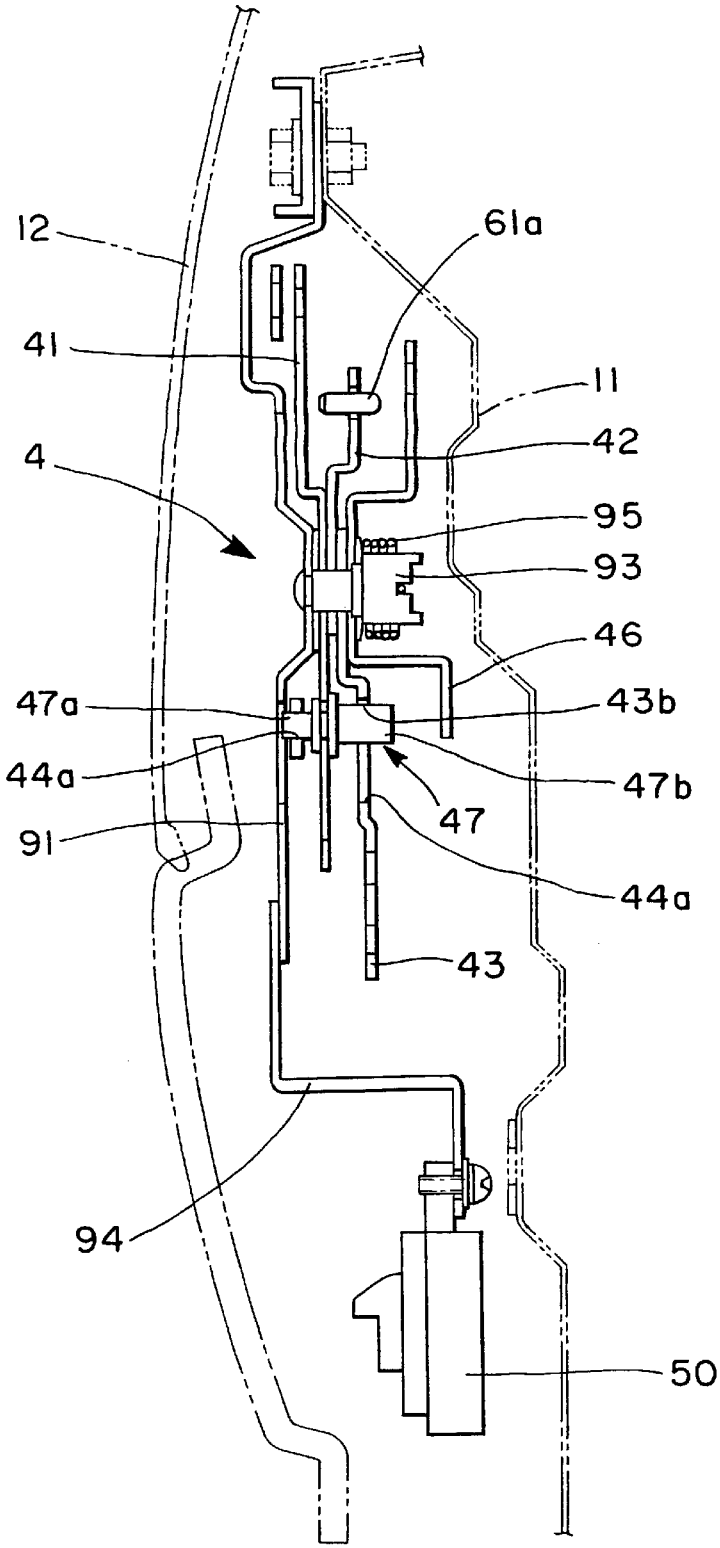
FIG. 2 is a vertical sectional view of the vehicular door opening and closing apparatus according to the invention.
Figure 3:
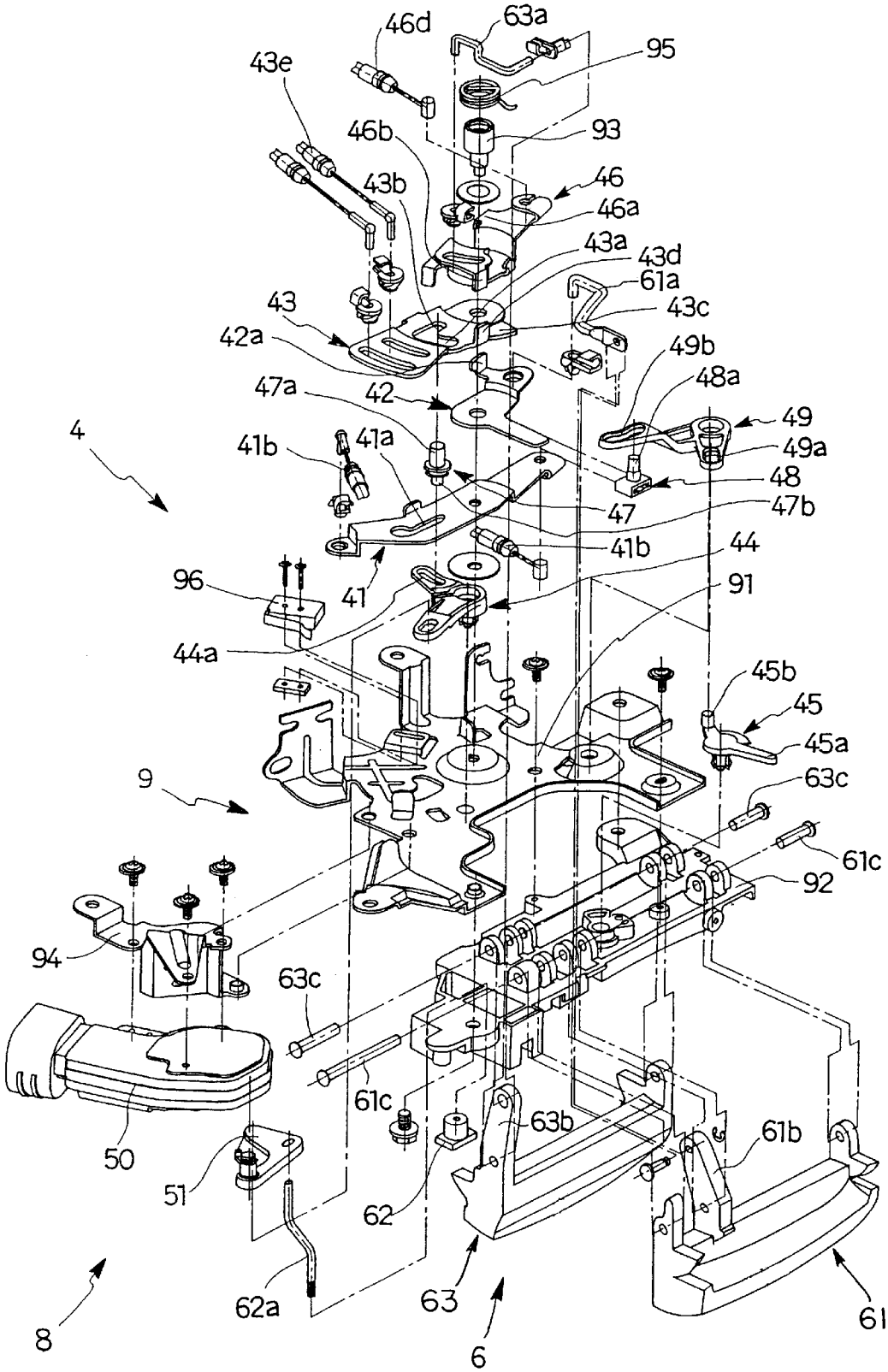
FIG. 3 is a disassembled perspective view of the vehicular door opening and closing apparatus according to the invention.

As shown by FIG. 2 and FIG. 3, the door opening and closing apparatus 8 is supported at a face of a door inner panel 11 of the slide door 1 on the compartment inner side. The remote control unit 4 of the door opening and closing apparatus 8 is covered by a compartment inner trim 12 attached to the door inner panel 11 and the inside handle unit 6 of the door opening and closing apparatus 8 is arranged at an opening of an edge portion of the inner door 1 in a direction of closing the slide door 1 formed at the compartment inner trim 12.

The remote control unit 4 comprises a base bracket 91, a lift lever 41, an inside lever 42, an open lever 43, a locking lever 44, a child lock lever 45 and a fully open lock lever 46. Further, the inside handle unit 6 comprises a handle base 92, an inside handle 61, a lock knob 62 and a fully open lock handle 63.

Figure 4:
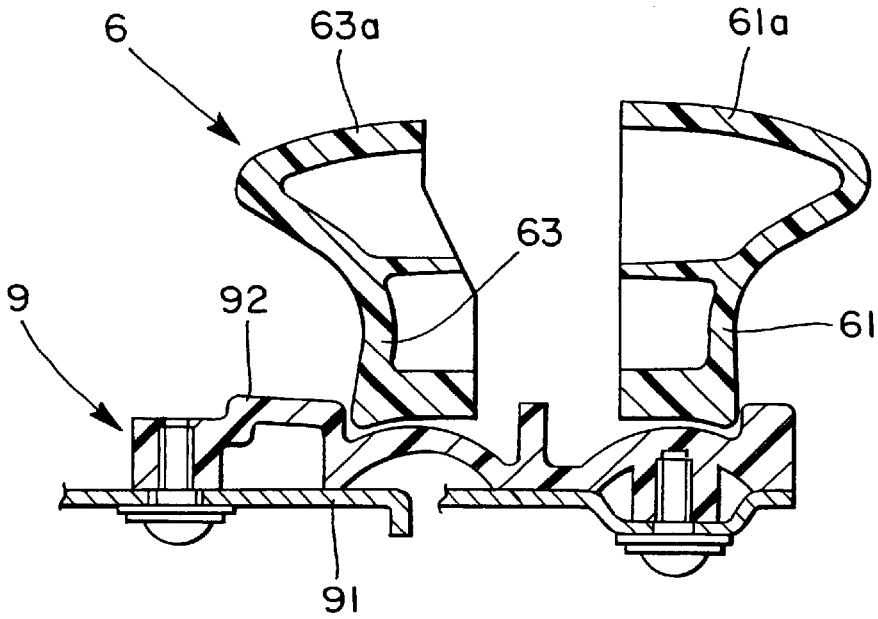
FIG. 4 is a sectional view showing a structure of supporting an inside handle unit and a lever unit of the vehicular door opening and closing apparatus according to the invention.

As shown by FIGS. 2 and 4, the base bracket 91 comprises a plate member made of a metal and is fastened and fixed to the door inner panel 11 by bolts or the like. The handle base 92 is made of synthetic resin and is fastened and fixed to the base bracket 91 by bolts or the like. A base unit 9 supporting the door opening and closing apparatus 8 at the door inner panel 11 is constituted by the base bracket 91 and the handle base 92. Further, the base unit 9 may be constructed by a constitution integrating base bracket 91 and the handle base 92 into a single member by metal or synthetic resin.

The base bracket 91 is erected with a coaxial shaft 93 by caulking. The lift lever 41, the inside lever 42, the open lever 43 and the fully open lock lever 46 are rotatably supported by the coaxial shaft 93.

The lift lever 41 is pivotably supported by the coaxial shaft 93 substantially at a central portion in a longitudinal direction thereof and is connected and engaged with the latch units 3 via cables 41*b* at both ends thereof. The lift lever 41 is formed with a long hole 41*a* extended in a diameter direction of the coaxial shaft 93 and a slide bush 47 is slidably supported by the long hole 41*a* along the long hole 41*a*.

The open lever 43 is pivotably supported by the coaxial shaft 93 at one end thereof and is connected to an outside handle of the outside handle unit 7 via cables 43*e* at other end thereof. Thereby, pivoting of the open lever 43 is carried out by pushing or pulling a rod by operating the outside handle to pivotally move.

The open lever 43 is formed with a long hole 43*a* in a shape of a circular arc centering on the coaxial shaft 93 and a recess portion 43*b* extended in the diameter direction continuously from the long hole 43*a*. The slide bush 47 is integrally formed with an engaging and disengaging pin portion 47*a* and the engaging and disengaging pin 47*a* is inserted slidably into the long hole 43*a* and engageably and disengageably movable into the recess portion 43*b*. Further, a leg portion 43*c* is formed to extend in the open lever 43.

The inside lever 42 is constituted substantially in an L-like shape, pivotably supported by the coaxial shaft 93 at a corner portion thereof and is connected to the inside handle 61 via a rod 61*a* at one end thereof. A slide bush 48 is supported at other end of the inside lever 42 slidably in the diameter direction of the coaxial shaft 93. The slide bush 48 is integrally formed with an engaging and disengaging pin portion 48*a* engageable with and disengageable from the leg portion 43*c*.

The locking lever 44 is supported by the base bracket 91 pivotably by snap engagement. The locking lever 44 is formed with a long hole 44*a* in a shape of a circular arc centering on the coaxial shaft 93. The slide bush 47 is integrally formed with a connecting pin portion 47*b* extended to a side thereof opposed to the engaging and disengaging pin portion 47*a* and the connecting pin portion 47*b* is inserted into the long hole 44*a* in the circular arc shape.

According to such a constitution, by pivoting the locking lever 44, the connecting pin portion 47*b* is pushed by a wall portion of the circular arc long hole 44*a*, the slide bush 47 is made to slide along the long hole 41*a*, thereby, the engaging and disengaging pin portion 47*a* is engaged with and disengaged from the recess portion 43*b* to thereby engage and disengage engagement of the lift lever 41 and the open lever 43, that is, the latch unit 3 and the open lever 43 (remote control unit 4) and produce an unlocked state and a locked state of the slide door 1 (the latch unit 3 is not operated even when the inside handle unit 6 and the outside handle unit 7 are operated).

Figure 5:
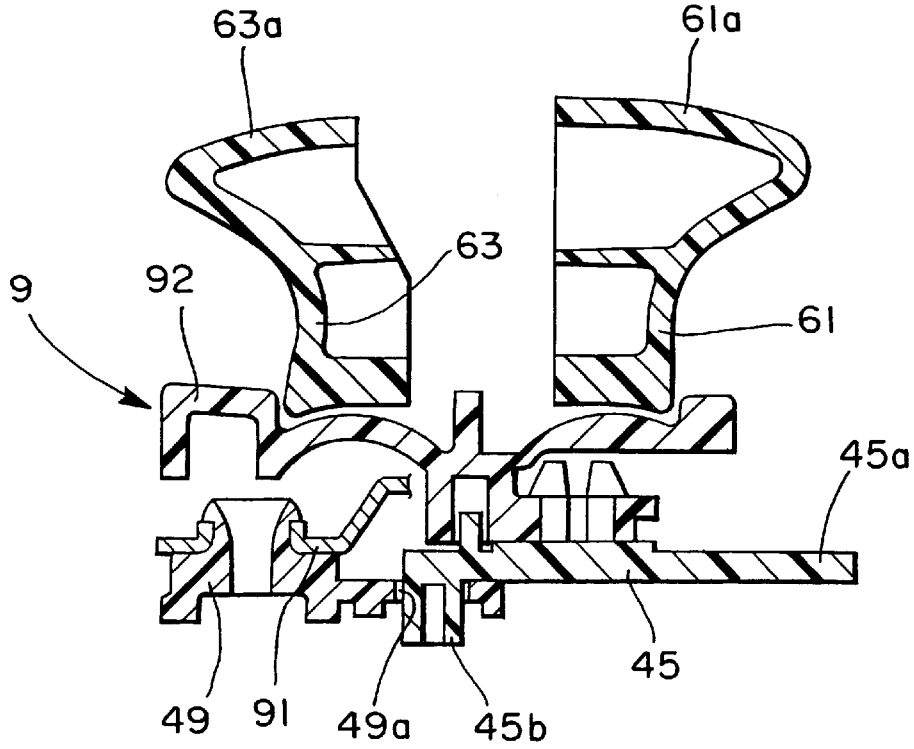
FIG. 5 is a sectional view showing a structure of supporting a child lock lever of the inside handle unit of the vehicular door opening and closing apparatus according to the invention.

As shown by FIG. 5, the child lock lever 45 is pivotably supported by the handle base 92 by snap engagement. The child lock lever 45 is integrally formed with an operating portion 45*a* and a pin portion 45*b*. A connecting lever 49 in a bifurcated shape is pivotably supported by the base bracket 91 by snap engagement. A long hole 49*a* is formed at one leg portion of the connecting lever 49 and a long hole 49*b* in a shape of a circular arc centering on the coaxial shaft 93 is formed at other arm portion.

The pin portion 45*b* is inserted into the long hole 49*a*, thereby, the child lock lever 45 and the connecting lever 49 are connected. The engaging and disengaging pin portion 48*a* of the slide bush 48 is inserted into the circular arc long hole 49*b*.

In such a constitution, by pivoting the child lock lever 45, the connecting lever 49 is pivoted, the engaging and disengaging pin portion 48*a* is pushed by a wall portion of the circular arc long hole 49*b*, the slide bush 48 is made to slide, thereby, the engaging and disengaging pin portion 48*a* is engaged with and disengaged from the leg portion 43*c* to thereby engage and disengage engagement between the open lever 43 and the inside lever 42, that is, the open lever 43 (remote control unit 4) and the inside handle unit 6 and produce a child lock release state and a child lock state (the latch unit 3 is not operated even when the inside handle unit 6 is operated).

The inside handle 61 is pivotably supported at the handle base 92 by pins 61*c*. The inside handle 61 is connected to one end of the inside lever 42 at an arm portion 61*b* via the rod 61*a*. Thereby, pivoting of the inside lever 42 is carried out by pushing and pulling the rod 61*a* by operating the inside handle 61 to pivotally move.

The base bracket 91 is fixed with a locking actuator 50 by a bracket 94. The locking actuator 50 is of a well-known structure in which the locking actuator 50 is driven and returned to an initial position by an electric motor and an output lever 51 thereof is connected to the locking lever 44 via a long hole 44*b* formed in the locking lever 44 by a pin portion 51*a* formed integrally therewith.

The lock knob 62 is slidably supported by the handle base 92. The lock knob 62 is connected to the output lever 51 via a rod 62*a*. Thereby, pivoting of the locking lever 63 is carried out by pivoting the output lever 61 and by pivoting the output lever 51 by driving the locking actuator 50 by pushing and pulling the rod 62*a* by operating the lock knob 62 to slide.

Further, when the locking actuator 50 is driven, since the output lever 51 is connected to the lock knob 62 via the rod 62*a*, the lock knob 62 is also operated to slide in accordance with pivotal movement of the output lever 50.

The fully open lock lever 46 is pivotably supported by the coaxial shaft 93 at a central portion in a longitudinal direction thereof. The fully open lock lever 46 is connected and engaged with the fully open lock unit 10 at one end thereof via a cable 46*d* and is connected to the fully open lock handle 63 via a rod 63*a* at other end thereof.

The fully open lock handle 63 is pivotably supported by the handle base 92 by pins 63*c*. The fully open lock handle 63 is connected to other end of the lock lever 46 at an arm portion 63*b* thereof via a rod 63*a*. Thereby, pivoting of the fully open lock lever 46 is carried out by pushing and pulling the rod 63*a* by pivotally operating the lock handle 63.

One end and other end of the fully open lock lever 46 are formed with a pair of engaging flanges 46*a* and 46*b*. The engaging flange 46*a* is opposed to an engaging flange 42*a* formed at the inside lever 42 and when the inside lever 42 is pivoted by operating the inside handle 61, the engaging flange 42*a* and the engaging flange 46*a* are engaged with each other to thereby pivot the fully open lock lever 46.

The engaging flange 46*b* is opposed to an engaging flange 43*d* formed at the open lever 43 and when the open lever 43 is pivoted by operating the outside handle of the outside handle unit 7, the engaging flange 43*d* and the engaging flange 46*a* are engaged with each other to thereby pivot the fully open lock lever 46. In this way, the fully open lock lever 46 is pivoted by pivoting the open lever 43 and the inside lever 42, that is, by operating the outside handle of the outside handle unit 7 and the inside handle 61.

When the fully open lock lever 46 is pivoted by operating the fully open lock handle 63, the engaging flanges 46*a* and 46*b* are separated from the engaging flanges 42*a* and 43*d* and accordingly, the open lever 43 and the inside lever 42 are not pivoted and only the fully open lock lever 46 is pivoted by itself.

Figure 7:
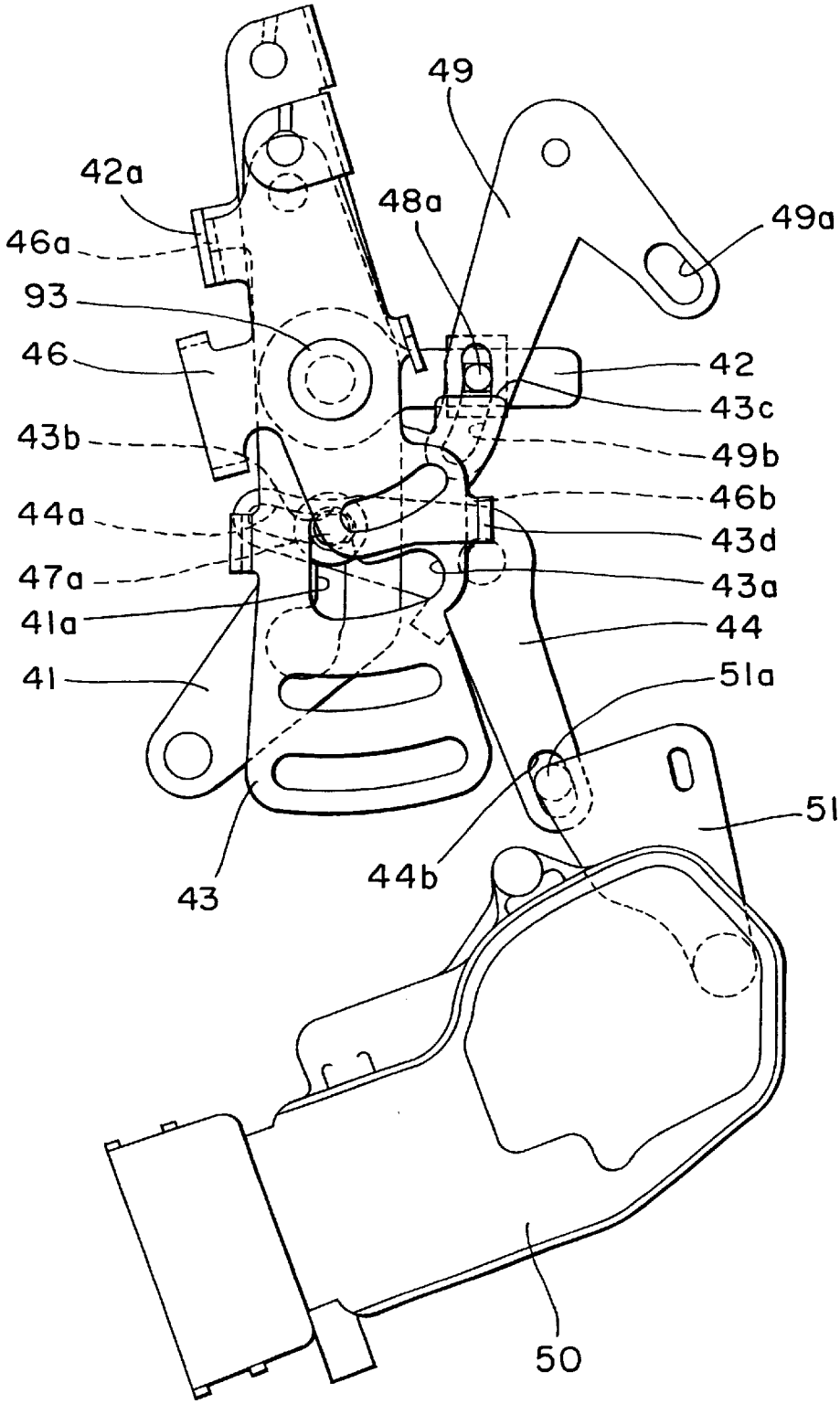
FIG. 7 is a front view showing an initial state of a lever unit of the vehicular door opening and closing apparatus according to the invention.

A spring 95 one end of which is locked by the fully open lock lever 46 and other end of which is locked by the coaxial shaft 93 is arranged around the coaxial shaft 93 and according to the fully open lock lever 46, the engaging flanges 46*a* and 46*b* are always urged in a direction of engaging with the engaging flanges 43*d* and 42*a* by receiving urge force of the spring 95 and is held at an initial position shown by FIG. 7.

Also the open lever 43 and inside lever 42 receive the urge force of the spring 95 via engagement between the engaging flanges 46*a* and 46*b* and the engaging flanges 43*d* and 42*a* and are held at initial positions shown in FIG. 7. Further, as is well known, the initial positions are set by stoppers of the inside handle 61, the fully open lock handle 63, and the outside handle of the outside handle unit 7.

The base bracket 91 is fixed with a switch 96. Terminals of the switch 96 are brought into contact with the fully open lock lever 46. The fully open lock lever 46 is pivoted by operating the inside handle 61, the fully open lock handle 63 and the outside handle of the outside handle unit 7 and accordingly, by the single switch 96, for example, a switch for starting a power slide door drive apparatus can be constituted.

Figure 6:
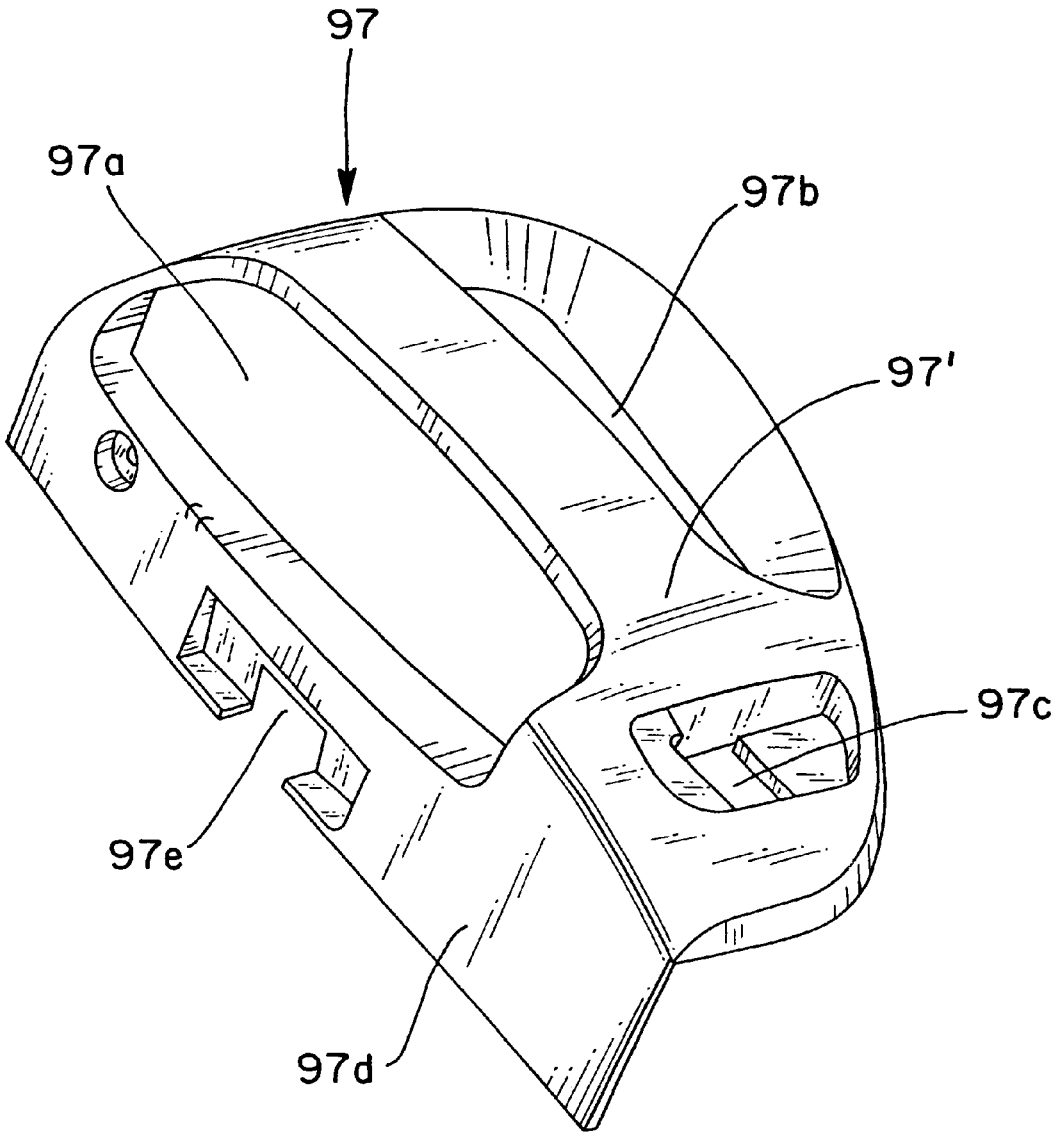
FIG. 6 is a perspective view showing a garnish of the vehicular door opening and closing apparatus according to the invention.

The handle base 92 is fixed with a garnish 97 shown by FIG. 6 covering the inside handle unit 6. As shown by FIG. 6, the garnish 97 is provided with a trim face 97' substantially flash with the compartment inner trim 12 of the slide door 1 and the trim face 97' is formed with a first, a second and a third opening portion 97*a*, 97*b* and 97*c*.

The first, the second and third opening portions 97*a*, 97*b* and 97*c* are arranged with operating portions of the inside handle 61, the fully open lock handle 63 and the lock knob 62, a direction of operating the inside handle 61 coincides with a direction of operating to open the slide door 1 and a direction of operating the fully open lock handle 63 coincides with a direction of operating to close the slide door 1.

Further, also a side face 97*d* orthogonal to the trim face 97' is formed with a fourth opening portion 97*e* and the fourth opening portion 97*e* is arranged with the operating portion 45*a* of the child lock lever 45. The fourth opening portion 97*e* arranged with the operating portion 45*a* is disposed at an end face of the slide door 1 in a direction of closing thereof and when the slide door 1 is brought into a closed state relative to the vehicle body 2, the fourth opening portion 97*e* is closed by the vehicle body 2, thereby, operation of the child lock lever 45 is made impossible.

Next, an explanation will be given of operation.

FIG. 7 shows an initial state of the remote control unit 4, the slide bush 47 is brought into an unlocked state engaged with the recess portion 43*b* and the slide bush 48 is brought into a child lock release state engaged with the leg portion 43*c*.

When the inside handle 61 is operated to operate to open the slide door 1, the slide lever 42 is pivoted in the clockwise direction of FIG. 7. At this occasion, the engaging flange 42*a* is engaged with the engaging flange 46*b* to thereby pivot the fully open lock lever 46 in the clockwise direction of FIG. 7 against the urge force of the spring 95.

Figure 8:
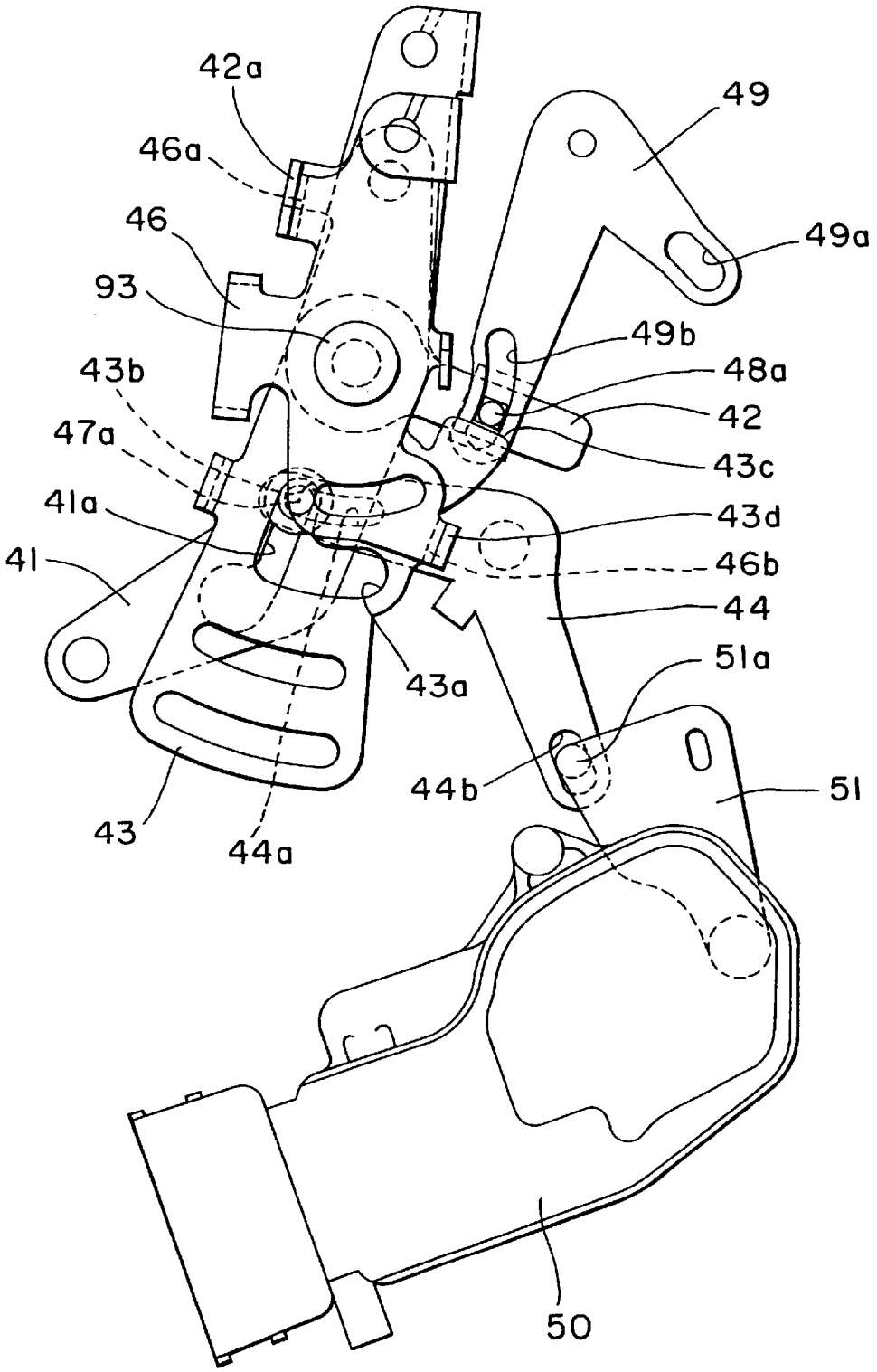
FIG. 8 is a front view showing the lever unit when operating an inside handle of the vehicular door opening and closing apparatus according to the invention.

In pivoting the inside lever 42, the slide bush 48 is moved to a lower side of FIG. 7 along the circular arc long hole 49*b* to thereby push the leg portion 43*c*, the open lever 43 is pivoted in the clockwise direction of FIG. 7 and in pivoting the open lever 43, the slide bush 47 is moved in the left direction of FIG. 7 along the circular arc long hole 44*a* to thereby pivot the lift lever 41 in the clockwise direction of FIG. 7. Thereby, the latch units 3 are operated and the slide door 1 is operated to open (shown in FIG. 8).

Figure 9:
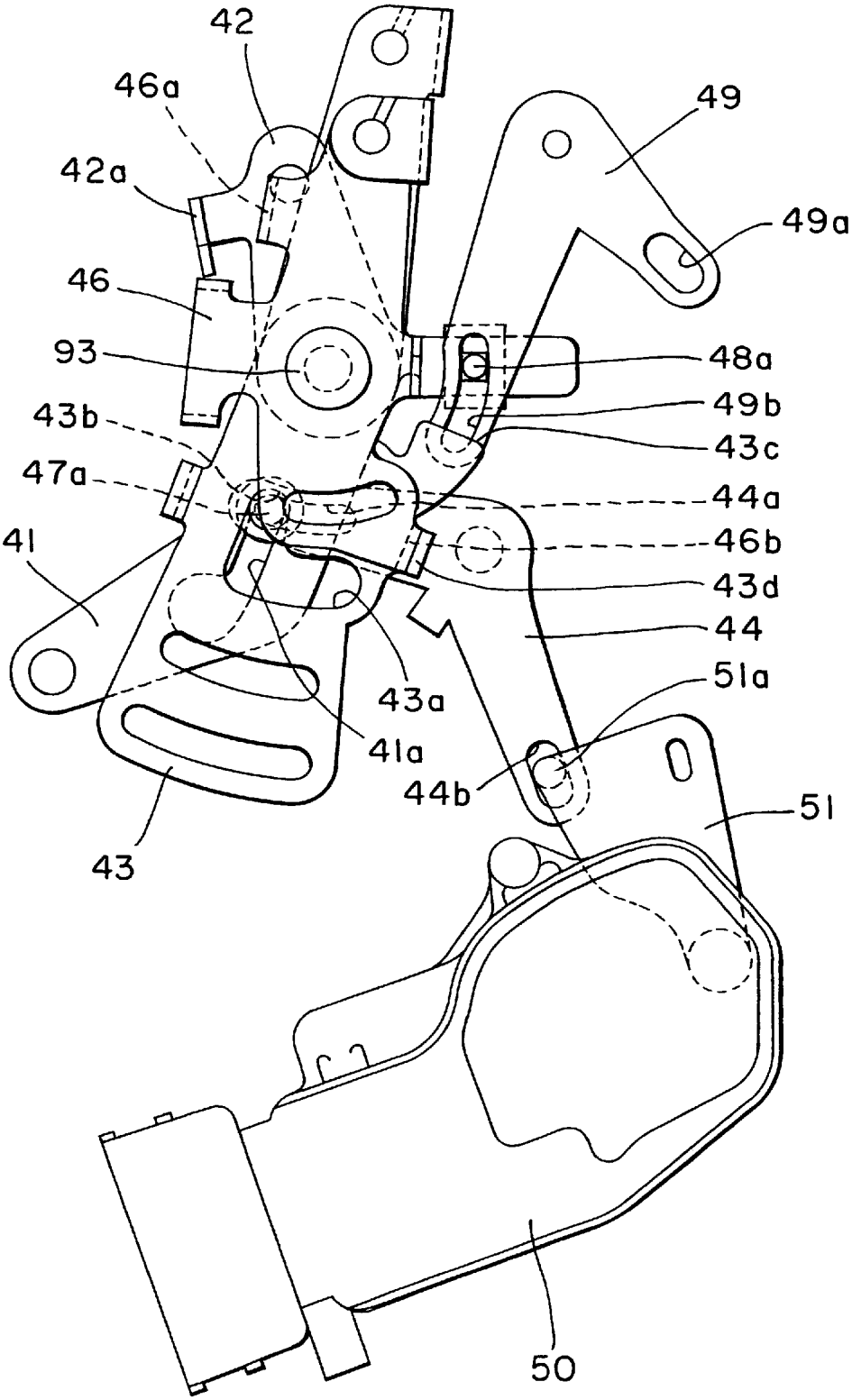
FIG. 9 is a front view of the lever unit when operating an outside handle of the vehicular door opening and closing apparatus according to the invention.

When the outside handle of the outside handle unit 8 is operated to pivot the slide door 1, the open lever 43 is pivoted in the clockwise direction of FIG. 7. At this occasion, the engaging flange 42*a* is engaged with the engaging flange 46*b* to thereby pivot the fully open lock lever 46 in the clockwise direction of FIG. 7 against the urge force of the spring 95. In pivoting the open lever 43, the slide bush 47 is moved in the left direction of FIG. 7 along the circular arc long hole 44*a* to thereby pivot the lift lever 41 in the clockwise direction of FIG. 7. Thereby, the latch units 3 are operated and the slide door 1 is operated to open (shown in FIG. 9).

Figure 10:
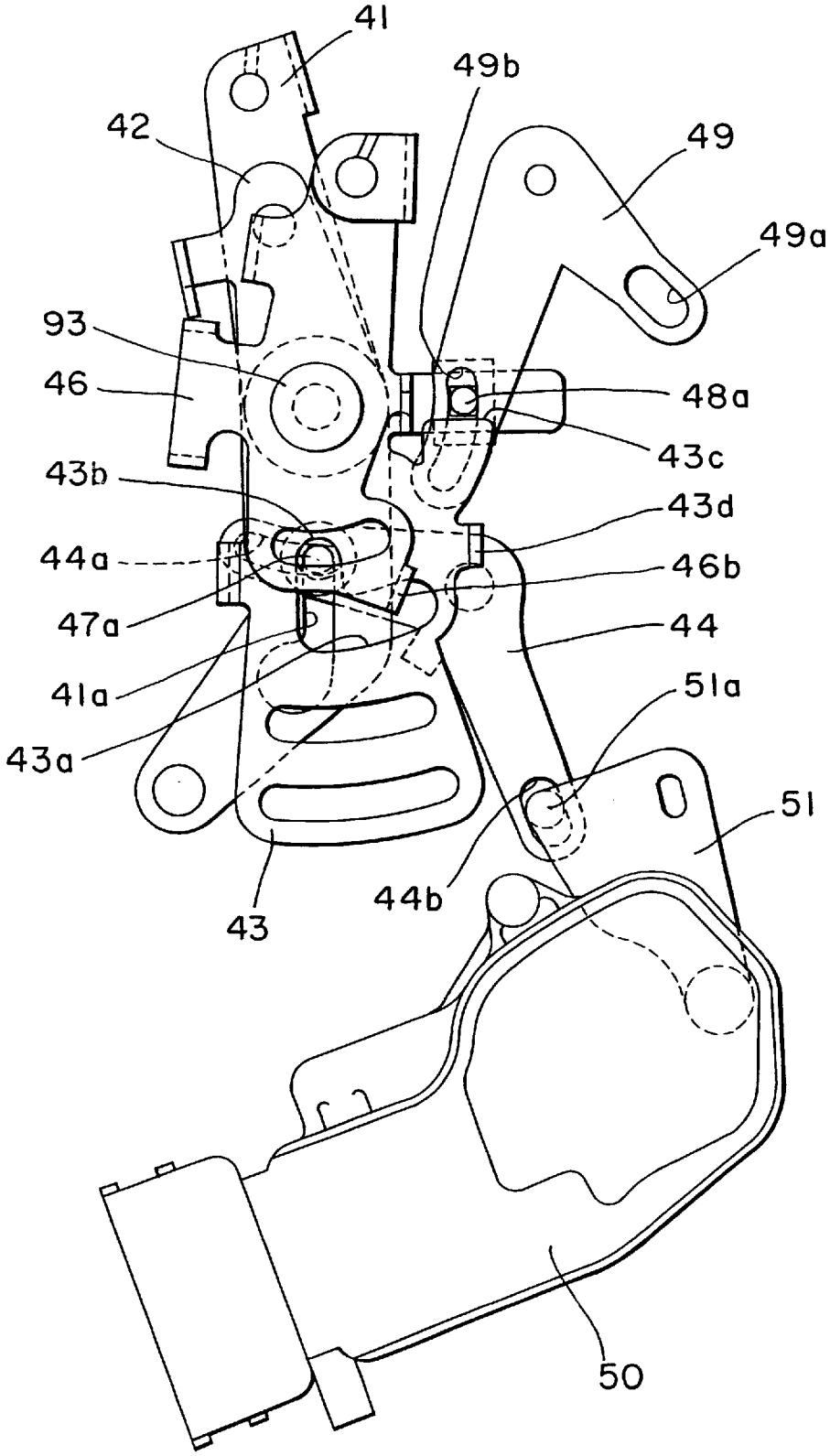
FIG. 10 is a front view showing the lever unit when operating a fully open lock handle of the vehicular door opening and closing apparatus according to the invention.

When the fully open lock handle 63 or the outside handle of the outside handle unit 8 is operated to operate to close the slide door 1, the fully open lock lever 46 is pivoted in the clockwise direction of FIG. 7 against the urge force of the spring 95. Thereby, the fully open lock unit 10 is operated and the slide door 1 is operated to close (shown in FIG. 10).

Figure 11:
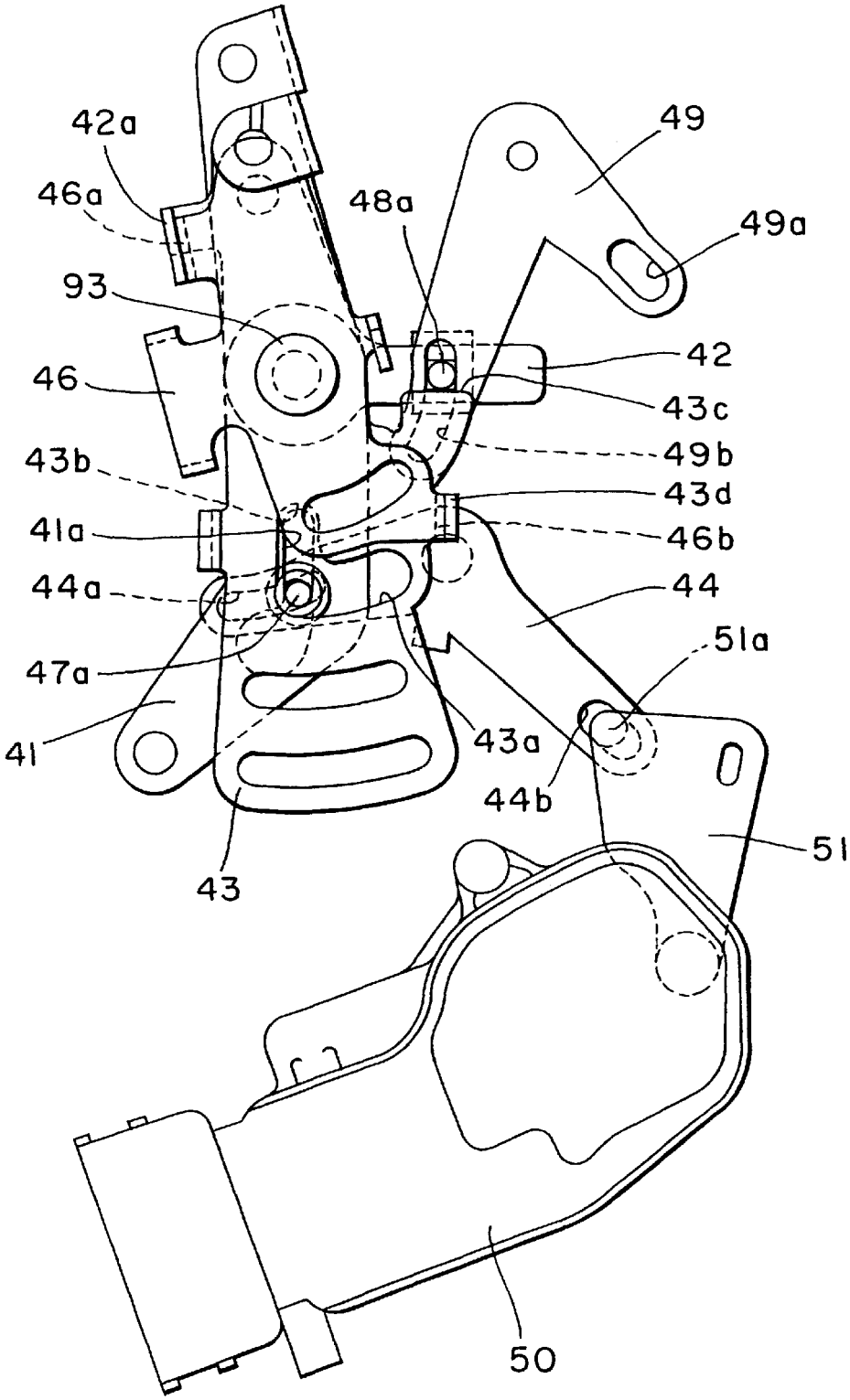
FIG. 11 is a front view showing the lever unit when operating a lock knob of the vehicular door opening and closing apparatus according to the invention.
Figure 13:
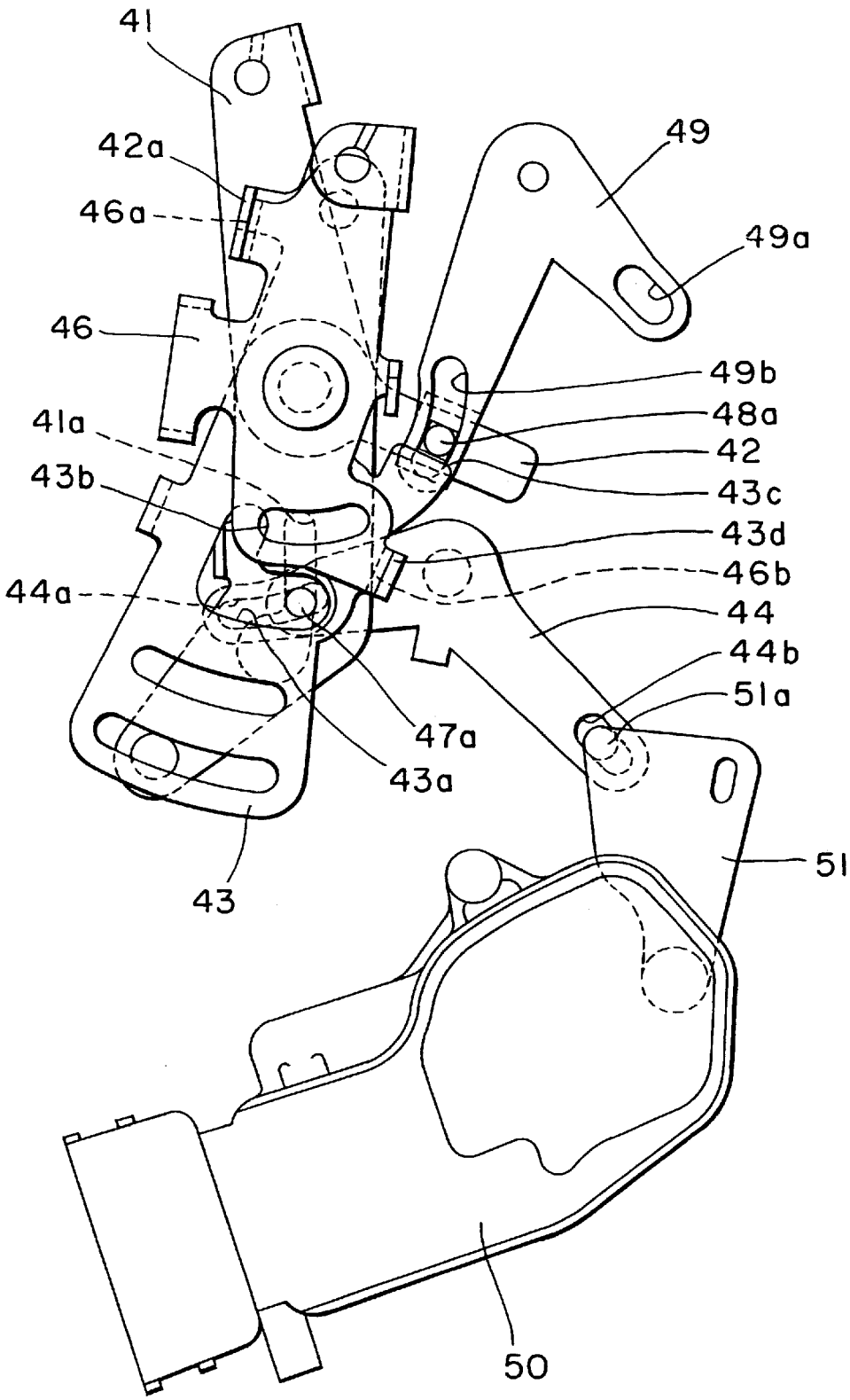
FIG. 13 is a front view of the lever unit showing operation of the vehicular door opening and closing apparatus according to the invention in a locked state.

When the lock knob 62 is operated, the locking lever 63 is pivoted in the counterclockwise direction of FIG. 7 via the output lever 51. In pivoting the locking lever 63, the slide bush 47 is moved to slide in the lower direction of FIG. 7 along the long hole 41*a* to thereby release engagement of the engaging and disengaging pin portion 47*a* from the recess portion 43*b* (shown in FIG. 11). Thereby, the slide door 1 is brought into a locked state. At this occasion, even when the inside handle 61 or the outside handle of the outside handle unit 8 is operated, the open lever 43 is idly pivoted relative to the lift lever 41 and the latch unit 63 is not operated (shown in FIG. 13).

Figure 12:
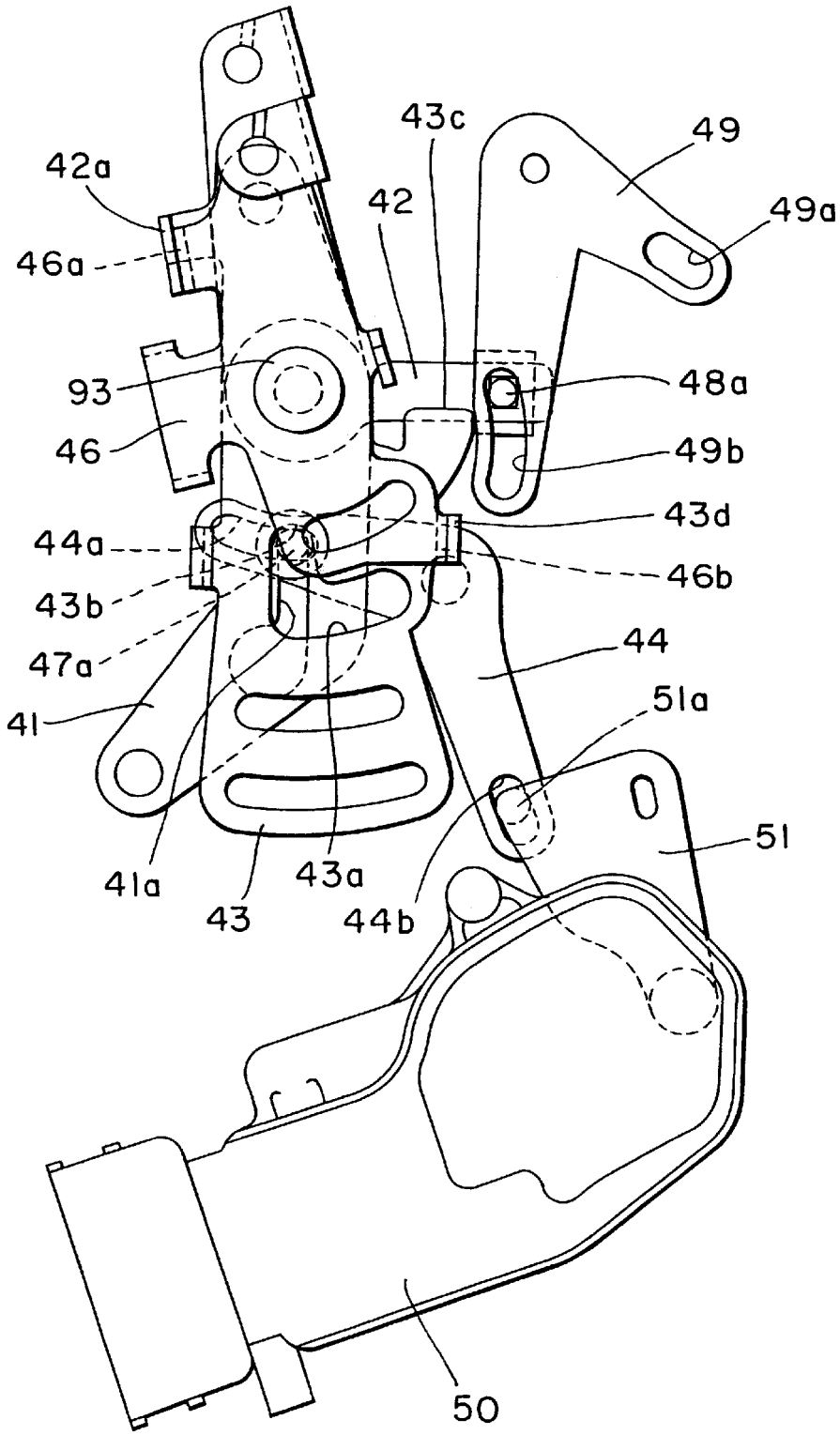
FIG. 12 is a front view showing the lever unit when operating a child lock lever of the vehicular door opening and closing apparatus according to the invention.

When the child lock lever 45 is operated, the connecting lever 49 is pivoted in the counterclockwise direction of FIG. 7. In pivoting the connecting lever 49, the slide bush 48 is moved to slide in the left direction of FIG. 7 relative to the inside lever 42 to thereby release engagement of the engaging and disengaging pin portion 48*a* from the leg portion 43*c* (shown in FIG. 12). Thereby, the slide door 1 is brought into a child lock state.

Figure 14:
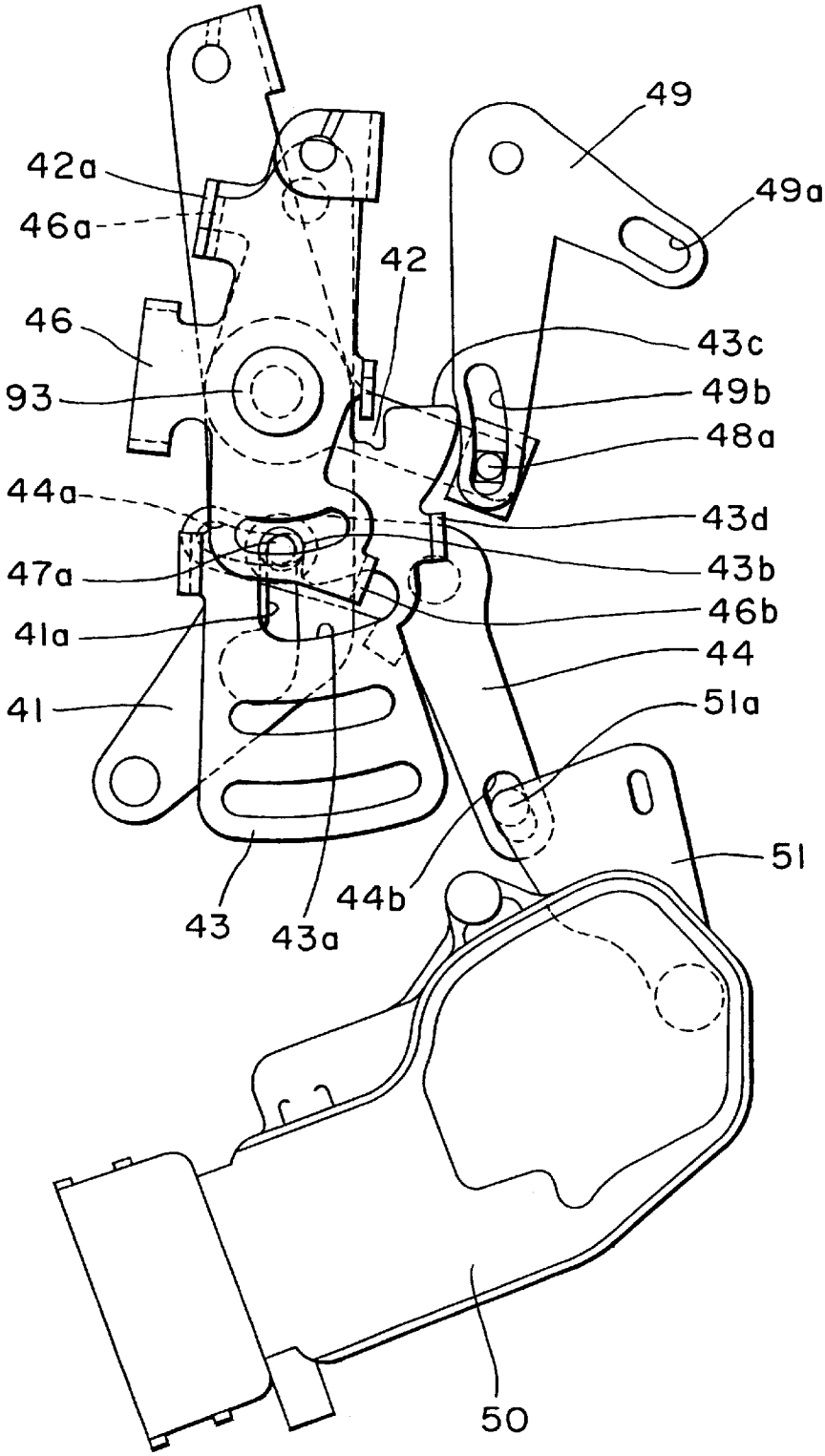
FIG. 14 is a front view of the lever unit showing operation of the vehicular door opening and closing apparatus according to the invention in a child lock state.

At this occasion, even when the inside handle 61 is operated, the inside lever 42 is idly pivoted relative to the open lever 43 and the latch units 3 are not operated (shown in FIG. 14). When the outside handle of the outside handle unit 8 is operated, the open lever 43 is pivoted and therefore, the latch units 3 are operated so far as the slide door 1 is not brought into the locked state.

Although according to the embodiment, the door opening and closing apparatus 8 is constituted by the inside handle unit 6 and the remote control unit 4 for the slide door 1, the embodiment is applicable also as a door opening and closing apparatus of a pivotable door.

According to the invention, the lever unit is attached and integrated to the inside handle unit and accordingly, arrangement of rods, wires, cables or the like for connecting and engaging the inside handle unit and the lever unit in the vehicular door can be dispensed with, simplification of the assembling operation of the vehicular door and a reduction in a number of parts are realized and considerable cost reduction can be achieved.

Further, according to the invention, the lever unit is attached and integrated to the inside handle unit and accordingly, the lever unit can be arranged at the face of the door inner panel on the compartment inner side, robbery preventive performance can be promoted and waterproof performance can also be promoted.

As many apparently widely different embodiments of the present invention can be made without departing from the spirit and scope thereof, it is to be understood that the invention is not limited to the specific embodiments thereof except as defined in the appended claims.

What is claimed is:

1. A vehicular door opening and closing apparatus comprising:

a base unit adapted to be fixed to a door inner panel of a vehicular door;

a compartment inner side opening operating member pivotably supported by the base unit by way of at least one fastener engaging both the base unit and the compartment inner side opening operating member; and an open lever pivotably supported by the base unit and operatively with the compartment inner side opening operating member, the open lever being adapted to be operatively connected with a latch unit of the vehicular door to hold the vehicular door in a closed state relative to a vehicle body the base unit being located between the open lever and the compartment inner side opening operating member.

2. The vehicular door opening and closing apparatus according to claim 1:

wherein the base unit comprises:

a base bracket adapted to be fixed to the door inner panel of the vehicular door for pivotably supporting the open lever; and a handle base fixed to the base bracket for pivotably supporting the compartment inner side opening operating member.

3. The vehicular door opening and closing apparatus according to claim 2, further comprising:

a locking lever pivotably supported by the base unit for engaging and disengaging engagement between the latch unit and the open lever; and a compartment inner side locking operating member connected and engaged with the locking lever and movably supported by the base unit.

4. The vehicular door opening and closing apparatus according to claim 2:

wherein the base unit is adapted to be fixed to a face of the door inner panel on a compartment inner side.

5. The vehicular door opening and closing apparatus according to claim 1, further comprising:

a locking lever pivotably supported by the base unit for engaging and disengaging engagement between the latch unit and the open lever; and a compartment inner side locking operating member connected and engaged with the locking lever and movably supported by the base unit.

6. The vehicular door opening and closing apparatus according to claim 5, further comprising:

a lift lever pivotably supported by the base unit and adapted to be connected and engaged with the latch unit; and a slide bush slidably supported by the lift lever, connected to the locking lever and engageable and disengageable with and from the open lever.

7. The vehicular door opening and closing apparatus according to claim 6, further comprising:

a coaxial shaft for pivotably supporting the lift lever and the open lever;

a long hole in a shape of a circular arc formed at the locking lever and centering on the coaxial shaft; and a connecting pin portion formed at the slide bush and inserted into the long hole in the shape of the circular arc.

8. The vehicular door opening and closing apparatus according to claim 5, further comprising:

a locking actuator supported by the base unit, connected to the locking lever and connected to the compartment inner side locking operating member.

9. The vehicular door opening and closing apparatus according to claim 1:

wherein the base unit is adapted to be fixed to a face of the door inner panel on a compartment inner side.

* * * * *